US008066159B2

(12) United States Patent
Stern

(10) Patent No.: US 8,066,159 B2
(45) Date of Patent: Nov. 29, 2011

(54) DOSING DEVICE AND DOSING UTENSIL FOR GRANULAR MATERIAL, SUCH AS SALT

(75) Inventor: Leif Stern, Lomma (SE)

(73) Assignee: Inoflex AB, Lomma (SE)

( * ) Notice: Subject to any disclaimer, the term of this patent is extended or adjusted under 35 U.S.C. 154(b) by 327 days.

(21) Appl. No.: 12/441,413

(22) PCT Filed: Sep. 26, 2007

(86) PCT No.: PCT/SE2007/000843

§ 371 (c)(1),
(2), (4) Date: Mar. 16, 2009

(87) PCT Pub. No.: WO2008/039133

PCT Pub. Date: Apr. 3, 2008

(65) Prior Publication Data

US 2009/0289082 A1 Nov. 26, 2009

(30) Foreign Application Priority Data

Sep. 28, 2006 (SE) ..... 0602023

(51) Int. Cl.
*A47G 19/24* (2006.01)
*G01F 11/26* (2006.01)
*B65D 47/00* (2006.01)

(52) U.S. Cl. ..... 222/565; 222/454; 222/457.5

(58) Field of Classification Search ..... 222/454, 222/457.5, 481, 565, 142.1–142.9; 426/115
See application file for complete search history.

(56) References Cited

U.S. PATENT DOCUMENTS 1,233,812 A 7/1917 Sawyer et al.
1,682,804 A 9/1928 Searight
2,252,835 A 8/1941 Chenette
5,000,387 A 3/1991 Szuhay
5,429,281 A 7/1995 Sellers
6,352,180 B1 3/2002 Reyhons
2004/0206785 A1 * 10/2004 Stern ..... 222/434

FOREIGN PATENT DOCUMENTS

DE 25 28 006 A1 12/1976
DE 25 57 715 A1 6/1977
WO WO 03/022110 A1 3/2003

* cited by examiner

*Primary Examiner* — Darren W Gorman
(74) *Attorney, Agent, or Firm* — Capitol City TechLaw

(57) ABSTRACT

A dosing device (1) for sprinkling granules (2) comprises upper elements (3) which delineate a storage space (4) for the granules, and lower elements (5) with a portion (6) which forms the bottom (6*a*) of the storage space and is provided with delivery apertures (7) for the granules. For rapid and even distribution of the granules (2), the delivery apertures (7) are distributed along the whole surface of the portion (6) of said lower elements (5) which forms the bottom (6*a*) of the storage space (4), and said lower elements comprise a dosing arrangement (8) in the form of a delivery element (9) which surrounds the delivery aperture, runs upwards in the storage space and is provided with an upper inlet aperture (10) and a delivery duct (11), and of a hoodlike element (12) which covers the delivery element, narrows upwards in the storage space, delineates between itself and the delivery element a flow duct (13) and runs to the vicinity of the bottom of the storage space, the section (4*a*) of the storage space which is situated radially within an imaginary downward extension of the hoodlike element being in communication with the delivery aperture so that granules in that section, upon rapid vertical and/or substantially vertical movements downwards, are guided in by the flow duct to above the inlet aperture of the delivery element in order to be able, via the inlet aperture, to fall through the delivery duct of the delivery element to the delivery aperture.

1 Claim, 3 Drawing Sheets

DOSING DEVICE AND DOSING UTENSIL FOR GRANULAR MATERIAL, SUCH AS SALT

BACKGROUND TO THE INVENTION

The present invention relates to a dosing device for sprinkling granules of salt or flavorings or mixtures containing salt and/or flavorings, which dosing device comprises upper elements which delineate at least one storage space for the granules, and lower elements which comprise a portion which forms the bottom of the storage space and is provided with delivery apertures for sprinkling the granules from the dosing device in a downward direction as a result of a rapid vertical and/or substantially vertical movement being applied to the dosing device for each dosing operation. The present invention also relates to a dosing utensil.

BRIEF SUMMARY OF THE INVENTION

An object of the present invention is to provide a dosing device as above which allows rapid and even distribution of a certain quantity of granules across the whole surface of the product which is to be salted and/or flavored.

This is achieved with the dosing device as defined above by the delivery apertures being distributed along the whole surface of the portion of said lower elements which forms the bottom of the storage space, and by said lower elements also comprising a dosing arrangement which is fitted in the storage space, is coordinated with the respective delivery aperture and comprises partly a delivery element which runs upwards in the storage space from the bottom of the storage space, surrounds the delivery aperture and is provided with an upper inlet aperture and a delivery duct which connects the inlet aperture to the delivery duct, and partly a hoodlike element which covers the delivery element, narrows internally upwards in the storage space, delineates between itself and the delivery element a flow duct extending round the delivery element and runs downwards in the storage space to the vicinity of the bottom of the storage space, while the section of the storage space which is situated radially within an imaginary extension downwards of the hoodlike element is in communication with the delivery aperture so that granules in that section, upon rapid vertical and/or substantially vertical movements downwards, are guided in by the flow duct to above the inlet aperture of the delivery element in order thereafter to be able, via the inlet aperture, to fall through the delivery duct of the delivery element to the delivery aperture.

Another object is to provide a dosing utensil adapted to being easy to handle, which is achieved by a dosing device of the above or similar type with upper and lower elements being used as a dosing head for a dosing utensil which also comprises a handle fitted to upper portions of the dosing head and running substantially parallel with the underside of the dosing head's lower portions provided with delivery apertures, with the possibility, when holding the handle, of the dosing utensil being subjected to rapid vertical and/or substantially vertical movements in order to sprinkle the granules.

Other objects and advantages of the invention will suggest themselves to one skilled in the art who examines the attached drawings and the following detailed description of preferred embodiments.

DETAILED DESCRIPTION OF PREFERRED EMBODIMENTS OF THE INVENTION

Figure 1:
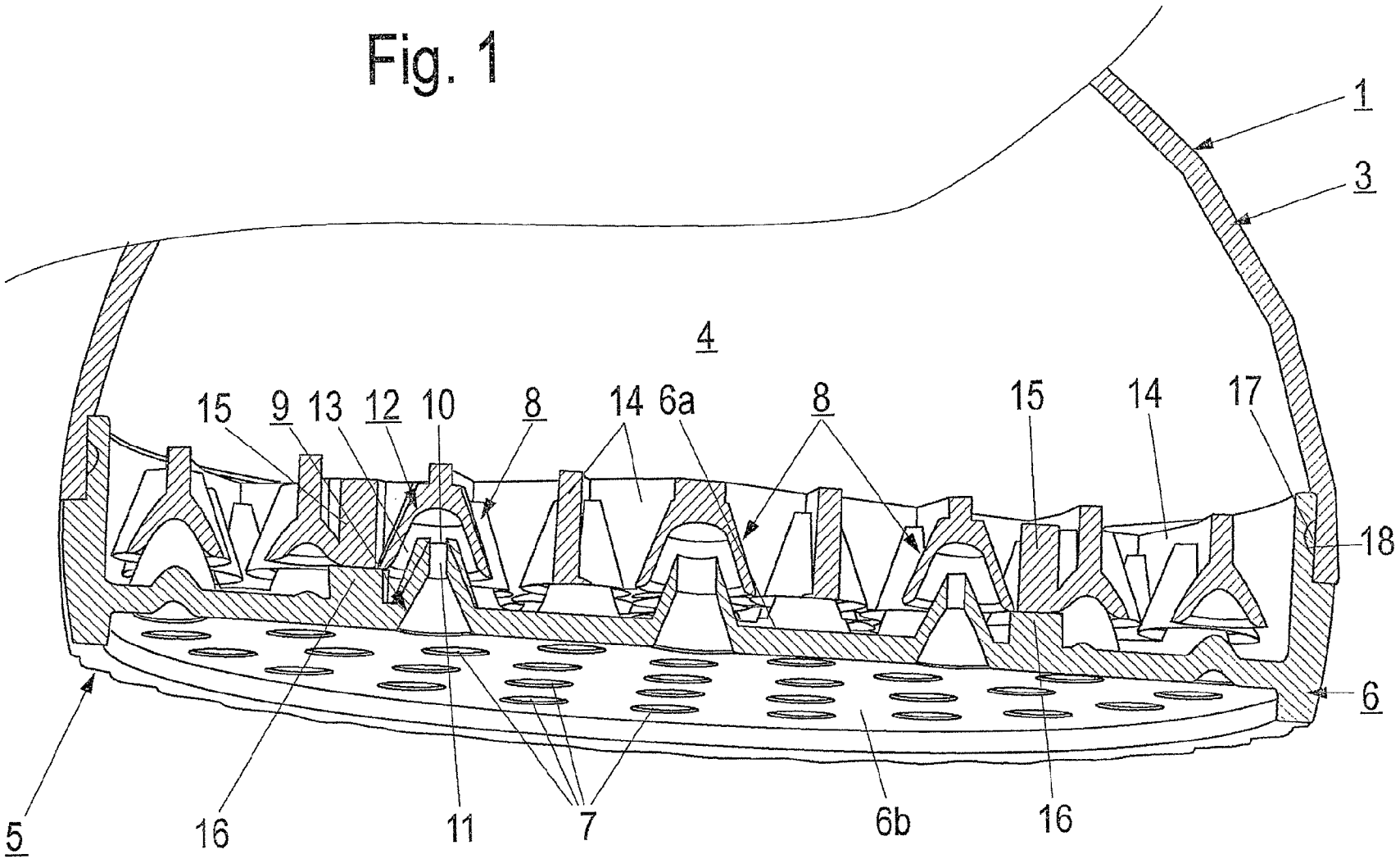
FIG. 1 is a cutaway perspective view of part of a dosing device according to the present invention.

FIG. 1 depicts part of a dosing device according to the present invention in a preferred embodiment. The dosing device 1 is intended to sprinkle granules 2 (see FIGS. 2*a-d*) of salt or flavorings or mixtures containing salt and/or flavorings. The dosing device 1 comprises upper elements 3 which delineate at least one storage space 4 for the granules 2. The dosing device 1 also comprises lower elements 5 which themselves comprise a portion 6 which forms the bottom 6*a* of the storage space 4 and which is provided with delivery apertures 7 for sprinkling the granules 2 from the dosing device 1 downwards as a result of the dosing device being subjected to rapid vertical and/or substantially vertical movements, i.e. the dosing device being moved up and down in a manner approximately corresponding to the hammer movements involved in using a hammer to drive in a nail.

To achieve rapid and even distribution of a dosed quantity of granules 2 across the whole surface of the product which is to be salted and/or flavored, e.g. a hamburger (not depicted), the delivery apertures 7 are distributed along the whole surface of the portion 6 of said lower elements 5 which forms the bottom 6*a* of the storage space 4, and said lower elements also comprise a dosing arrangement 8 fitted in the storage space and coordinated with the respective delivery aperture.

Each dosing arrangement 8 comprises a delivery element 9 surrounding the delivery aperture 7 and running upwards in the storage space 4 from the latter's bottom 6*a*. This delivery element 9 comprises an upper inlet aperture 10 and a delivery duct 11 which connects the inlet aperture to the delivery aperture 7. Each dosing arrangement 8 also comprises a hoodlike element 12 which covers the delivery element 9, i.e. it screens the delivery element off on all sides from the storage space 4. A flow duct 13 extending round the delivery element is delineated between the hoodlike element 12 and the delivery element 9. The hoodlike element 12 runs downwards in the storage space 4 to the vicinity of the bottom 6*a* of the storage space in such a way as to leave a gap between the end portion 12*a* of the hoodlike element and the bottom of the storage space.

Figure 2:
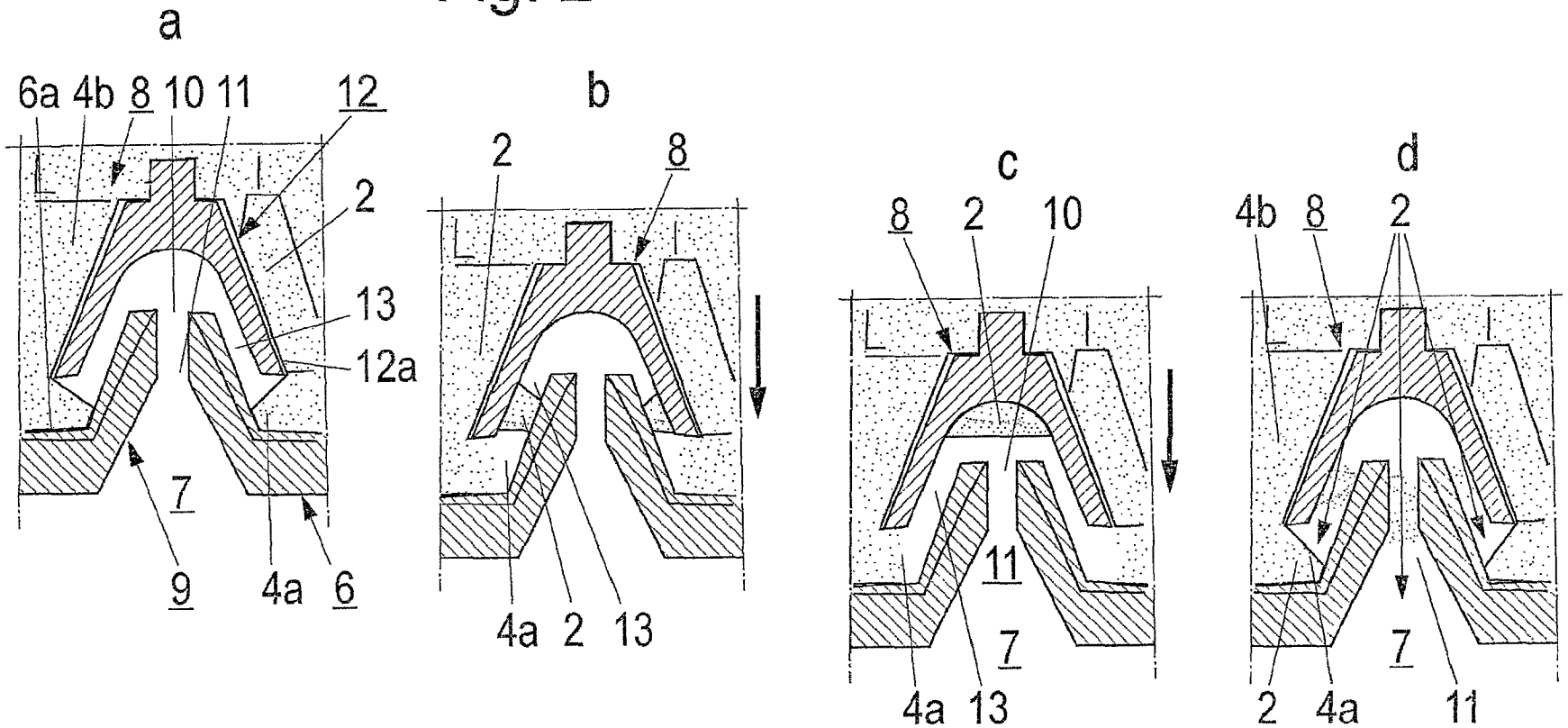
FIGS. 2*a-d* are highly schematic sectional views of a portion of the dosing device according to FIG. 1 at various stages during a sprinkling operation.

The foregoing configuration results in the section 4*a* of the storage space 4 which is situated radially within an imaginary downward extension of the hoodlike element 12 being in communication with the delivery aperture 7 via the flow duct 13 and the delivery element 9. Upon rapid vertical and/or substantially vertical movements downwards, granules 2 in this section 4*a* are guided in, from the situation according to FIG. 2*a*, by the flow duct 13 (see FIG. 2*b*) to above the inlet aperture 10 of the delivery element 9, i.e. the situation according to FIG. 2*c*. As illustrated in FIGS. 2*a-c*, it is in practice the dosing device 1 which during said rapid vertical and/or substantially vertical movements downwards moves in a vertical direction, while the granules from the section 4*a* of the storage space 4, during such movements, are at substantially the same height, while at the same time the internally narrowing shape of the hoodlike element 12 causes them to move in sideways until they are above the middle of the inlet aperture 10. Thereafter, in practice when the rapid vertical and/or substantially vertical movements downwards cease or at least become slow enough for the force of gravity to overcome the downward movements, or upon rapid vertical and/or substantially vertical movements upwards, the granules 2, or at least the bulk of them, can, via the inlet aperture 10, fall through the delivery duct 11 of the delivery element 9 to the delivery aperture 7 and out from the dosing device 1 (see FIG. 2*d*). At the same time, a small proportion of the granules 2 falls back to said section 4*a* of the storage space 4 via the flow duct 13, as also illustrated in FIG. 2*d*.

The section 4*a* of the storage space 4 which is situated radially within said imaginary downward extension of the hoodlike element 12 is also in communication with other sections 4*b* of the storage space which contain granules 2. When the section 4*a* of the storage space 4 has thus been substantially emptied of granules 2 by rapid vertical and/or substantially vertical movements, which granules thereafter fall through the delivery aperture 7 onto the product which is thereby sprinkled, granules 2 in said other sections 4*b* are caused to flow into the first-mentioned section 4*a* of the storage space (see FIG. 2*d*). This therefore takes place simultaneously with the departure of the first-mentioned granules 2 from the dosing device 1, i.e. when the rapid vertical and/or substantially vertical movements downwards cease or become slower, or upon rapid vertical and/or substantially vertical movements upwards. A new dose of granules 2 is thereafter ready for delivery by the dosing device 1 being again subjected to rapid vertical and/or substantially vertical movements downwards, repeating the process described above.

As illustrated in FIG. 1, the delivery elements 9 of all the dosing arrangements 8 are formed integrally with the portion 6 of the lower elements 5 of the dosing device 1 which forms the bottom 6*a* of the storage space 4. The manufacture of these components of said lower elements 5 is thus facilitated.

The hoodlike elements 12 of all the dosing arrangements 8 are also formed integrally with one another. This is achieved in the embodiment depicted by means of ribs 14 which run between the hoodlike elements 12 (see FIG. 1). Fitting portions 15 of these ribs 14 rest, in the embodiment depicted, on elevations 16 on the bottom 6*a* of the storage space 4 and can therefore be detachably connected, e.g. via these elevations, to said portion 6 of the lower elements 5 of the dosing device 1 which forms said bottom, e.g. they may be screwed firmly thereto. The hoodlike elements 12 may also with advantage be connected detachably to the delivery elements 9 of the dosing arrangement 8 or be formed integrally with the delivery elements and the portion 6 which forms the bottom 6*a* of the storage space 4. In the embodiment depicted, the fitting portions 15 and the elevations 16 also cause the hoodlike elements 12 to be at a suitable distance from the bottom 6*a* of the storage space 4.

Whatever the kind of salt or flavoring or mixture of salt and/or flavorings which is to be sprinkled, it is possible, if so desired, for the dosing device to be so configured that the quantity or dose of granules 2 sprinkled is adjustable in various ways. For example, the delivery element 9 and the hoodlike element 12 of the respective dosing arrangement 8 may be adapted to being movable vertically relative to one another so that the size of the flow duct 13 is altered. The hoodlike element 12 being for example movable vertically relative to the portion 6 which forms the bottom of the storage space, and hence also relative to the delivery element 9, makes it possible for the distance between the end portion 12*a* of the respective hoodlike element 12 and the bottom 6*a* of the storage space 4 to be adjustable. For the same purpose, the size of the inlet aperture 10 of the delivery element 9 may also be adjustable.

With the object of facilitating the guidance of the granules 2 in the flow duct 13, the respective delivery element 9 is with advantage also provided, as illustrated, with an external shape which narrows upwards in the storage space 4. The guidance of the granules 2 is further improved by the delivery element 9 narrowing conically and by the inside of the respective hoodlike element 12 likewise narrowing conically. Optimum guidance is achieved when the walls of the delivery element 9 and the hoodlike element 12 which delineate the flow duct 13 also run substantially parallel with one another. If the outside of the hoodlike element 12 also narrows conically upwards in the storage space 4, this results in the granules 2 in the storage space being suitably guided towards the aforesaid sections 4*a* of the storage space of the respective dosing arrangement 8.

Optimum spreading of the granules 2 over the whole surface of the product which is to be salted and/or flavored can be achieved by suitable arrangement of the delivery apertures 7, but a common prerequisite for optimum spreading is that the delivery apertures 7 are distributed evenly along the whole surface of the portion 6 of said lower elements 5 of the dosing device 1 which forms the bottom 6*a* of the storage space 4. Better spreading of the granules 2 is also achieved if the inside of the delivery elements 9 at least partly widens downwards in the storage space 4 so that the delivery duct 11 widens towards the delivery aperture 7, which may consequently be substantially larger than the inlet aperture 10.

To allow effective cleaning of the storage space 4 of the dosing device 1, said lower elements 5 of the dosing device are fitted detachably to the upper elements 3 of the dosing device, e.g. by being firmly screwed or, as in the embodiment depicted, firmly snapped to the latter elements by snap means 17 and 18 respectively.

Figure 3:
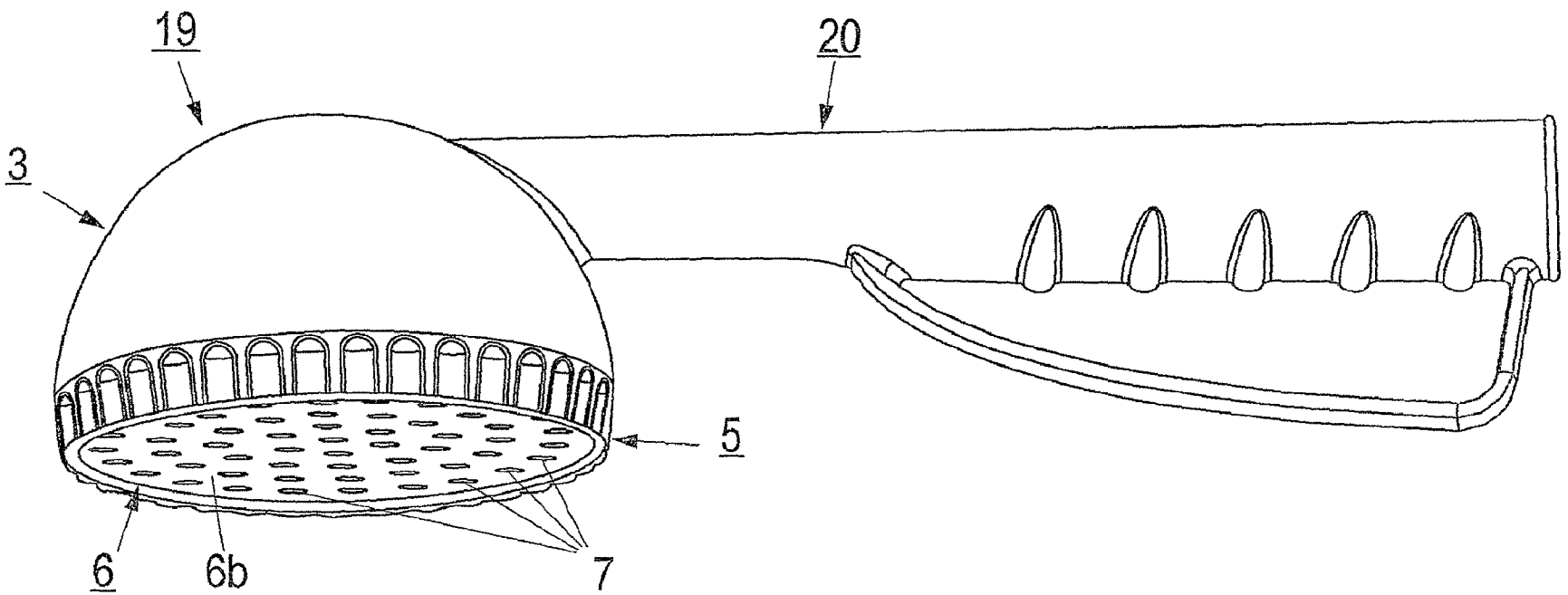
FIG. 3 is a perspective view of a dosing utensil in an embodiment in which the dosing device according to FIG. 1 serves as a dosing head.

The upper and lower elements 3, 5 described above of the dosing device 1 may together constitute a dosing head 19 for a dosing utensil (see FIG. 3) which also comprises a handle 20 fitted to said upper elements 3 and taking the form of, for example, a hammer handle running substantially parallel with the underside 6*b* of the portion 6 of said lower elements 5 which forms the bottom 6*a* of the storage space 4. When holding the handle 20 it is possible to subject the dosing utensil to rapid vertical and/or substantially vertical movements in order to sprinkle the granules 2. As illustrated in FIG. 3, the handle 20 is fitted to the top of the upper elements 3, and since in the embodiment depicted the lower portions of these elements are substantially circular, like the lower elements 5, the handle as seen from above extends substantially diametrally relative to the upper and lower elements.

In the dosing utensil in this unique configuration with the dosing head 19 and the dosing handle 20, the dosing head may of course more generally comprise upper elements 3 which delineate at least one storage space for granules of salt or flavorings or mixtures containing salt and/or flavorings, and lower elements 5 which have a plurality of the delivery apertures 7 for sprinkling the granules from the dosing head downwards, and hoodlike elements which are disposed above the delivery apertures, prevent the granules from falling out of the storage space and, together with delivery elements, delineate flow ducts by which the granules are caused to pass from the storage space and through the delivery apertures.

It will be obvious to one skilled in the art that the dosing device according to the present invention can be modified and altered within the scopes of the claims set out below without departing from the idea and objects of the invention. For example, the number of delivery apertures 7, and hence the number of dosing arrangements 8, may vary, as also may their shape. The shape of the delivery apertures 7 and the portions of the dosing arrangements 8 coordinated with them may therefore be other than circular, e.g. square or oblong. The delivery elements 9 and the hoodlike elements 12 may also be other than narrowing conically and the delivery elements need not narrow even on the outside, they may for example comprise straight pipe sections. The dosing device 1, like the dosing utensil, may be of some other suitable shape than that indicated by the drawings.

The invention claimed is:

1. A dosing device comprising:

a housing delineating a storage space, the housing having a bottom wall;

a plurality of delivery apertures provided in the bottom wall; and a plurality of dosing arrangements respectively coordinated with the delivery apertures, wherein each of the dosing arrangements includes a delivery element projecting from the bottom wall and into the storage space, the delivery element having an end with an inlet aperture and a delivery duct that connects the inlet aperture to the delivery aperture;

a hood element mounted in the storage space, the hood element having a recess that receives the end of the delivery element such that the inlet aperture is provided in the recess; and a flow duct delineated between the delivery element and the hood element, the flow duct extending round the delivery element, and connecting the storage space to the inlet aperture.

* * * * *